US010751596B2

(12) United States Patent
Kuijpers

(10) Patent No.: US 10,751,596 B2
(45) Date of Patent: Aug. 25, 2020

(54) TRAINING DEVICE FOR SIMULATING SKI MOVEMENTS

(71) Applicant: C&T HOLDING B.V., Son en Breugel (NL)

(72) Inventor: Twan Theodorus Petrus Kuijpers, Son en Breugel (NL)

(73) Assignee: C&T HOLDING B.V., Son en Breugel (NL)

( * ) Notice: Subject to any disclaimer, the term of this patent is extended or adjusted under 35 U.S.C. 154(b) by 49 days.

(21) Appl. No.: 16/068,678

(22) PCT Filed: Dec. 21, 2016

(86) PCT No.: PCT/NL2016/050900
§ 371 (c)(1),
(2) Date: Jul. 9, 2018

(87) PCT Pub. No.: WO2017/119809
PCT Pub. Date: Jul. 13, 2017

(65) Prior Publication Data

US 2019/0022498 A1 Jan. 24, 2019

(30) Foreign Application Priority Data

Jan. 8, 2016 (EP) ..... 16150536

(51) Int. Cl.
*A63B 69/18* (2006.01)
*A63B 21/22* (2006.01)
(Continued)

(52) U.S. Cl.
CPC ..... *A63B 69/18* (2013.01); *A63B 21/005* (2013.01); *A63B 21/157* (2013.01);
(Continued)

(58) Field of Classification Search
CPC ... A63B 21/005; A63B 21/157; A63B 21/225; A63B 21/4034; A63B 22/0069;
(Continued)

(56) References Cited

U.S. PATENT DOCUMENTS 3,807,727 A 4/1974 Ferguson
4,074,903 A * 2/1978 Diez de Aux ..... A63B 69/18 434/253

(Continued)

FOREIGN PATENT DOCUMENTS

EP 2509691 A 10/2012

OTHER PUBLICATIONS

ISR: European Patent Office, NL; dated Jun. 9, 2017.

*Primary Examiner* — Megan Anderson
(74) *Attorney, Agent, or Firm* — Patshegen IP LLC; Moshe Pinchas

(57) ABSTRACT

A training apparatus/device has a frame and two elongated pedal elements, which are pivotally connected to the frame. The pedal elements are each provided with a footrest and a pedal axle and are, by a coupling element connected to each other, so that the pedal elements, in use of the training apparatus, are held parallel to each other. Further, the training apparatus has a transmission mechanism, which is connected via the coupling element with the pedal elements, as well as resistance mechanism, which is connected to the transmission mechanism and is driven by lateral displacement of the pedal elements.
The coupling element is formed by an elongated element, whereby near each of the ends of the pedal elements is connected to the pedal element axles via a ball joint. As a result, this makes the training device less susceptible to interference and compact.

11 Claims, 2 Drawing Sheets

(51) Int. Cl.
*A63B 21/00* (2006.01)
*A63B 22/00* (2006.01)
*A63B 21/005* (2006.01)

(52) U.S. Cl.
CPC ..... *A63B 21/225* (2013.01); *A63B 21/4034* (2015.10); *A63B 22/0069* (2013.01); *A63B 2022/0028* (2013.01); *A63B 2022/0033* (2013.01); *A63B 2022/0074* (2013.01); *A63B 2244/19* (2013.01)

(58) Field of Classification Search
CPC ..... A63B 69/18; A63B 2022/0028; A63B 2022/0033; A63B 2022/0074; A63B 224/19
See application file for complete search history.

(56) References Cited

U.S. PATENT DOCUMENTS

| | | | | |
|---|---|---|---|---|
| 4,669,723 | A | 6/1987 | Arsenian | |
| 6,234,935 | B1 * | 5/2001 | Chu | A63B 21/018 482/51 |
| 2006/0211544 | A1 * | 9/2006 | Loane | A63B 21/0552 482/70 |
| 2009/0239713 | A1 * | 9/2009 | Chu | A63B 21/225 482/51 |
| 2012/0004077 | A1 * | 1/2012 | Chu | A63B 21/225 482/52 |
| 2012/0270194 | A1 * | 10/2012 | Kuijpers | A63B 21/0053 434/253 |

* cited by examiner

TRAINING DEVICE FOR SIMULATING SKI MOVEMENTS

FIELD OF THE INVENTION

The present invention relates to an exercise device for simulating ski movements, comprising:

a frame, two parallel elongated pedal elements, whereby:

on the rear portion of each of the pedal elements a footrest is present on each of the pedal elements, on the front portion, there is an extending pedal axle located on both an upper side as well as a lower side of the pedal elements, which when viewed from the under side to the upper side, the axle extends in a direction away from the other pedal element, when seen from the under side to the upper side, the axle extends towards the rear portion of the pedal element, the pedal axles are connected pivotally to the frame—both at the under side and at the upper side and whereby, the pedal elements are connected to each other by means of a coupling element, which, during use of the training apparatus, holds the pedal elements parallel to each other, furthermore connected to the pedal element is a transmission mechanism and connected to the transmission mechanism is a resistor mechanism, which is driven by the lateral displacement of the pedal element.

DESCRIPTION OF THE PRIOR ART

A known training device, similar to the present invention, is from EP2509691A. In the known training device, the coupling element consists of a central elongated element, of which the ends are connected to connecting elements, which are rotatable around three axles and are in turn, connected to the pedal elements. A disadvantage of the known training device is that the coupling element is relatively large and complex, with further susceptibility to failures and getting stuck due to the fact that the moving parts are an impediment in relation to each other.

SUMMARY OF THE INVENTION

An objective of the present invention is to provide a training apparatus—of the type described in the opening paragraph—which is less sensitive to interference and more compact than the known training device. To this end, the training device according to the invention is characterised in that the coupling element is formed by an elongated element, which, near each of the ends, is connected to one of the pedal elements via a ball joint/hinge, and that the resistance mechanism comprises a flywheel and the transmission mechanism is arranged to drive the flywheel, independent of the swinging direction of the pedal element, in one direction of rotation, whereby the transmission mechanism comprises a toothed belt connected to the coupling element, two toothed belt wheels and two sprockets, by which the toothed belt, coming from one of the pedal elements, is transferred to one of the toothed belt wheels, from which it is then transferred to one of the sprockets and then transferred to the other sprocket, and thereafter transferred to the other toothed belt wheel, each of the toothed belt wheels is connected by means of a freewheel clutch to the flywheel. In the known training device, however, both the toothed belt and the coupling element are connected to each of the pedal elements separately. In contrast, the training apparatus according to the present invention has obtained a more compact construction as a result of attaching the coupling element to each of the pedal elements, and in turn attaching the toothed belt to the coupling element.

Preferably, the toothed belt is transferred/fed to each of the toothed belt wheels in a motion of 180 degrees. Due to a large wrap angle, the diameter of the toothed belt wheels can be small and the transmission mechanism can be made compact.

Furthermore, the toothed belt is preferably also transferred/fed to each of the sprockets in a 180 degrees motion.

A further embodiment of the training device according to the invention is characterised, in that the coupling element is provided with an elongated recess between the two ends on a longitudinal side, along which, the toothed belt extends. During movement of the pedal elements, the coupling element makes a continuous movement towards and away from the toothed belt wheels. Due to the recess, the coupling element can be placed closer to the toothed belt wheels, by which the toothed belt wheels, during the movement of the coupling element, can extend. As a result, a more compact construction is obtained.

Yet a further embodiment of the training device is characterised according to the invention, in that the toothed belt is endless and is transferred to the coupling element. As a result, there is no need for a firm clamp mechanism to be present in order to connect the toothed belt with the ends of the coupling element with the pedal elements (as is the case with the known training device). The only caution that needs to be taken is to prevent the toothed belt—relative to the coupling element—from sliding out of place. For this purpose, a light construction to secure/fix the toothed belt in place can be used.

Moreover, a further favourable embodiment of the training device according to the invention is characterised, in that the toothed belt wheels are each connected—via one of the freewheel clutches—with a separate drive axle, whereby a geared belt wheel is mounted on each drive axle, which further determines which gears which are located below the toothed belt wheels engage with each other. The gears are hereby, thus located under the toothed belt at the height of the ends of the pedal elements. This is in contrast to the known training device, where the gears are located above the tooth belt wheels and thus require extra overall height. As a result, a more compact construction is possible.

Preferably, one of the drive axles is connected to the flywheel via an accelerating transmission which in turn, is connected to the flywheel via a flywheel axle. As a result, the same resistance can be obtained with a compacter flywheel as with a construction in which no accelerating transmission is present.

A beneficial construction of the coupling element is characterised, in that near each of the ends of the coupling element there is a hole through which a fixed axle linked to the respective pedal element protrudes, whereby, between the boundary wall of the hole and the axle, a ball hinge is constructed/fabricated.

A favourable embodiment of the training device according to the invention is characterised, in that, in the hole an insert element with cup-shaped inner side is present, and on the axle, a ring with spherical external side/outside is present, which is rotatable in the insert element.

A further favourable embodiment of the training device according to the invention is characterised, in that the insert element is shared.

A further disadvantage of the known training device is that the transmission mechanism is bulky/voluminous, thus making the training device difficult to move and store (due to its large size).

The resistance mechanism, therefore, preferably comprises an electromagnetic generator, which is connected to the flywheel.

BRIEF DESCRIPTION OF THE DRAWINGS

Below, the invention will be explained in more detail with reference to the drawings of the embodiments of the training device according to the present invention. In these drawings.

DETAILED DESCRIPTION OF THE DRAWINGS

Figure 1:
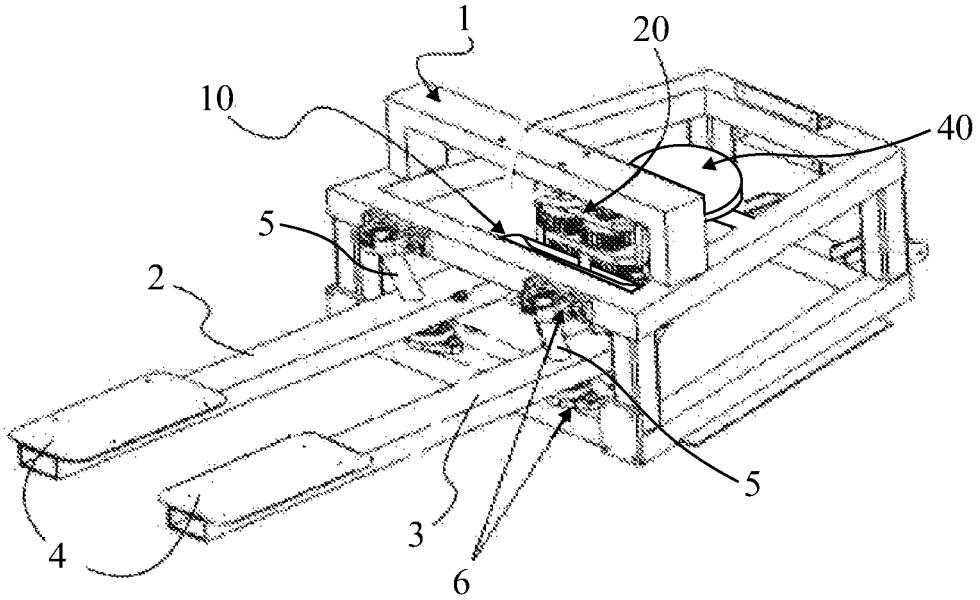
FIG. 1 shows the perspective of an embodiment of the training apparatus whereby the housing has been omitted.
Figure 2:
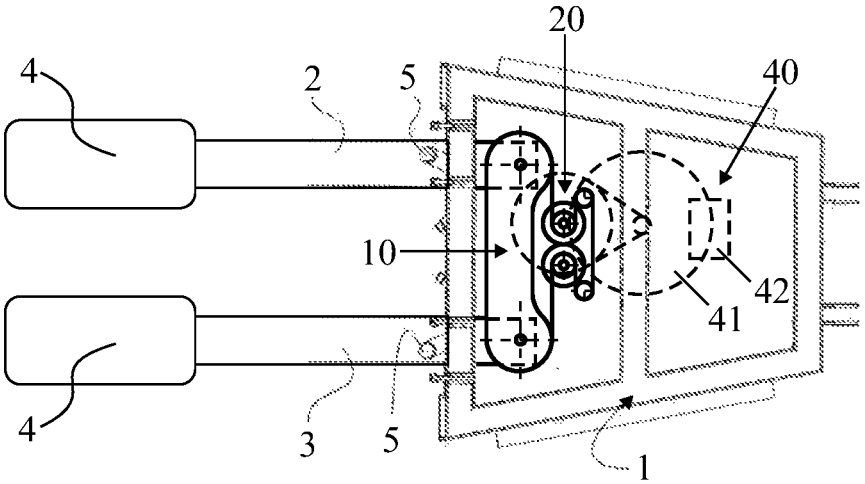
FIG. 2 shows the training device without housing in a plan view.

FIGS. 1 and 2, is a top plan view of an embodiment of the training device, according to the present invention, wherein the housing is omitted. The training apparatus has a frame (1) and two elongated pedal elements (2, 3), which are pivotally connected to the frame. The rear portion of each of the pedal elements are equipped with a foot support (4), and the front portion of each of the pedal elements are equipped with an extending pedal axle (5), which are located both on an upper side as well as a lower side of the pedal elements. When viewed from the under side to the upper side, each pedal axle extends in a direction away from the other pedal element. Additionally, when viewed from the under side to the upper side, each pedal axle extends towards the rear portion of the pedal element. Furthermore, the pedal axles are both connected to the frame—at both the top and at the bottom—by bearings (6).

In order to keep the pedal elements—during use of the training apparatus—parallel to each other, the pedal elements (2, 3) are connected to each other via a coupling element (10). Furthermore, the training apparatus comprises a transmission mechanism (20), which is connected to the pedal elements via the coupling element (10), as well as resistance mechanism (40), which is connected to the transmission mechanism and is driven by lateral displacement of the pedal elements.

Figure 3:
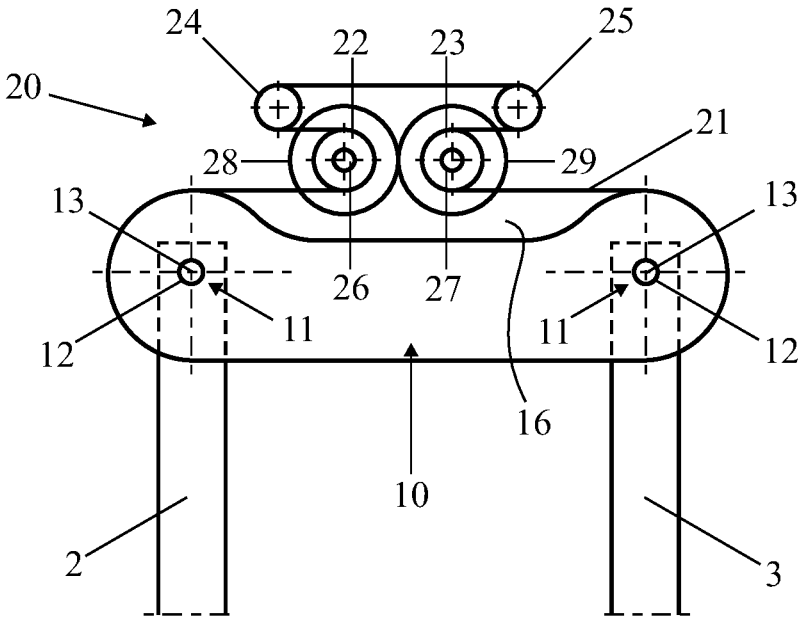
FIG. 3 illustrates the coupling element and the transmission mechanism of the training device in a plan view, whereby the frame has been omitted.
Figure 4:
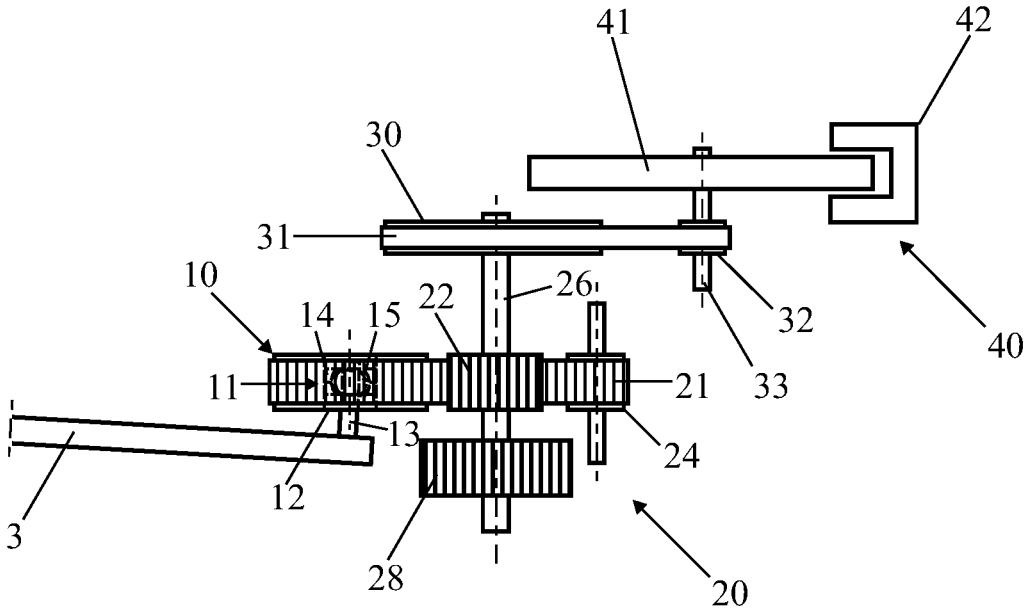
FIG. 4 shows the coupling element and the transmission mechanism in a side view perspective, without a frame.

In FIGS. 3 and 4, the coupling element (10) and the transmission mechanism (20) of the training device (wherein the frame has been omitted) are illustrated in a top view, in addition to a side view perspective. Here, the resistance mechanism (40) is formed by both a flywheel (41) as well as a flywheel that is connected with the electromagnetic generator (42).

Moreover, the coupling element (10) is formed by an elongated element, whereby each of the ends of the pedal elements is connected to the pedal element axles via a ball joint (11). Hereby, near each of the ends there is a hole (12) through which a fixed axle (13) (linked to the respective pedal element) protrudes, by which, between the boundary wall of the hole and the axle, a ball hinge is fabricated. The ball hinge is formed via the presence of a hole in the insert element (14) (which has a cup-shaped inner side), and the presence—on the axle—of a ring (15) (which has a spherical outer side) that is rotatable in the insert element. The insert element (14) is therefore shared in order to fabricate the spherical outer surface of the ring.

The transmission mechanism (20) is constructed to drive the flywheel (41), independent of the swinging direction of the pedal elements (2, 3), in one drive direction of rotation. This transmission mechanism is thus connected to the coupling element (10) via an endless toothed belt (21), which further comprises two toothed belt wheels (22, 23) and two sprockets (24, 25). Furthermore, the coupling element is—between the two ends—on a longitudinal side provided with an elongated recess (16) along which the toothed belt extends.

Coming from one of the ends of the coupling element (10), the toothed belt (21) is firstly transferred in a 180 degrees motion to the toothed belt wheels (22), which is then transferred to one of the sprockets (24) in a 180 degrees motion. From there, the toothed belt (21) is transferred—once again in a 180 degree motion—to the other sprocket (25), which is then followed by the transferal—in a 180 degrees motion—of the toothed belt to the other tooth belt wheel (23), and from there the toothed belt is transferred to the other end of the coupling element (10).

The toothed belt wheels (22, 23) are both connected via a freewheel clutch to the drive axles (26, 27). On each drive axle a gear wheel (28, 29) is attached. These gears, which are located under the toothed belt wheels (22, 23), engage with each other. Furthermore, One of the drive axles (26) is connected with a large belt wheel (30), see FIG. 4, which via a drive belt (31), drives a small belt wheel (32). This small belt wheel is mounted on a flywheel axle (33) upon which the flywheel (41) is attached.

Although in the above, the present invention is elucidated with reference to the drawings, it should be noted that the present invention is in no way limited to the embodiments shown in the drawings. The invention therefore extends to all embodiments deviating from the drawings within the context defined by the claims.

The invention claimed is:

1. A training apparatus for simulating a ski movements, comprising:

a frame, two parallel elongated pedal elements, whereby:

on the rear portion of each of the two parallel elongated pedal elements a footrest is present and, on each of the two parallel elongated pedal elements, on a front portion, there is an extending pedal axle extending between an upper side and a lower side of the two parallel elongated pedal elements, which when viewed from the lower side to the upper side, the extending pedal axle of one of the two parallel elongated pedal elements extends in a direction away from the other pedal element of the two parallel elongated pedal elements, when seen from the lower side to the upper side, each of the extending pedal axles extend towards a rear portion of each of the two parallel elongated pedal elements, the extending pedal axles are connected pivotally to the frame both at the lower side and at the upper side and whereby, the two parallel elongated pedal elements are connected to each other by means of a coupling element, which, during use of the training apparatus, holds the two parallel elongated pedal elements parallel to each other, furthermore connected to the two parallel elongated pedal elements is a transmission mechanism and connected to the transmission mechanism is a resistance mechanism, which is driven by a lateral displacement of the two parallel elongated pedal elements, wherein the coupling element is formed by an elongated element that near each of its ends, is connected to one of the two parallel elongated pedal elements via a ball hinge, and that the resistance mechanism comprises a flywheel and the transmission mechanism is arranged to drive the flywheel, independent of a swinging direction of the two parallel elongated pedal elements, in one direction of rotation, whereby the transmission mechanism comprises a toothed belt connected to the coupling element, two toothed belt wheels and two sprockets, by which the toothed belt, coming from one of the two parallel elongated pedal elements, is transferred to one of the two toothed belt wheels, from which it is then transferred to one of the two sprockets and then transferred to the other sprocket of the two sprockets, and thereafter transferred to the other toothed belt wheel of the two toothed belt wheels, one of the two toothed belt wheels is connected by means of a first freewheel clutch to the flywheel and the other one of the two toothed belt wheels is connected by means of a second freewheel clutch to the flywheel.

2. The training apparatus according to claim 1, wherein near each of the two ends of the coupling element, there is a hole through which a fixed axle linked to the respective pedal element of the two parallel elongated pedal elements protrudes, whereby, between a boundary wall of the hole and the extending pedal axle, a ball hinge is fabricated.

3. The training device according to claim 2, wherein in the hole an insert element with cup-shaped inner side is present, and on the extending pedal axle, a ring with spherical external side/outside is present, which is rotatable in the insert element.

4. The training device according to claim 3, wherein the insert element is divided into two parts.

5. The training device according to claim 1, wherein the toothed belt is transferred to each of the two toothed belt wheels in a 180 degrees motion.

6. The training device according to claim 5, wherein the toothed belt is transferred to each of the two sprockets in a 180 degrees motion.

7. The training device according to claim 1, wherein the two toothed belt wheels are each connected via one of the freewheel clutches with a separate drive axle, whereby a geared belt wheel is mounted on each of the separate drive axles, which determines which gears engage with each other.

8. The training device according to claim 7, wherein one of the separate drive axles is connected to the flywheel via an accelerating transmission; which in turn, is connected to the flywheel is a flywheel axle.

9. The training device according to claim 1, wherein the coupling element is between its two ends, on one of its longitudinal sides provided with an elongated recess along which the toothed belt extends.

10. The training device according to claim 1, wherein the toothed belt is endless and transferred to the coupling element.

11. The training device according to claim 1, wherein the resistance mechanism further comprises an electromagnetic generator, which is connected to the flywheel.

* * * * *